United States Patent [19]

Mitsui et al.

[11] 4,424,504

[45] Jan. 3, 1984

[54] FERRITE CORE

[75] Inventors: Tadashi Mitsui, Tokyo; Hiraku Imaizumi, Shisuimachi, both of Japan

[73] Assignee: TDK Electronics Co., Ltd., Tokyo, Japan

[21] Appl. No.: 388,636

[22] Filed: Jun. 15, 1982

[30] Foreign Application Priority Data

Jun. 19, 1981 [JP] Japan ..... 56-89428[U]
Jul. 1, 1981 [JP] Japan ..... 56-98866[U]

[51] Int. Cl.[3] ..... H01F 27/24
[52] U.S. Cl. ..... 336/83; 336/233
[58] Field of Search ..... 336/83, 212, 233, 234

[56] References Cited

U.S. PATENT DOCUMENTS 3,371,301 2/1968 Hisano ..... 336/83
4,352,081 9/1982 Kijima ..... 336/233 X

*Primary Examiner*—Thomas J. Kozma
*Attorney, Agent, or Firm*—Armstrong, Nikaido, Marmelstein & Kubovcik

[57] ABSTRACT

The new structure of a ferrite core for the use of a power transformer and/or a choke coil has been found. The core is assembled by a pair of identical core halves, and each core half comprises (a) a circular center boss (6), (b) a pair of outer walls (7, 8) positioned at both the sides of said boss for mounting a coil, (c) a pair of base plates (9, 10) coupling said center boss and said outer walls, (d) each of the outer walls being substantially rectangular with an external linear wall and an inner curved wall, (e) the core half being symmetrical with regard to the first plane including a center axis of said boss and being parallel with the external linear walls of said outer walls, (f) a concaved opening (R) being provided between said base plates in the first side of the core half with regard to the reference plane which includes a center axis of said boss and is perpendicular to said first plane, (g) the length ($B_1$) between said reference plane to the end of the first side which includes said concaved opening (R) being longer than the length ($B_2$) between said reference plane to the end of the second side which does not have said opening (R), and (h) said length ($B_2$) being the same as the radius ($a_1$) of the center boss.

7 Claims, 13 Drawing Figures

FERRITE CORE

BACKGROUND OF THE INVENTION

The present invention relates to the improved structure of a ferrite core, in particular, relates to such a core for the use of a transformer and/or a choke coil in a power supply circuit. The present ferrite core is utilized for a transformer and/or a choke coil in a power supply circuit in electric appliances up to 1 kW.

When the present core is utilized for a power transformer a primary power supply is applied to the transformer through a switching circuit operating by a DC power supply applying an alternate current input to the transformer, and thus, the desired secondary voltage is obtained at the output of the transformer.

When a ferrite core is utilized for a power transformer, that core must at least satisfy the following conditions.

(a) A core must not magnetically saturate, and preferably, the cross section along the magnetic path is identical for the whole magnetic path in the core.

(b) A core is preferably closed by itself for improving the shield effect for not disturbing an external circuit.

(c) The shape of a core is preferably simple, and a bobbin having windings can be easily mounted in a core, and lead wires of windings can extend easily outside of a core.

(d) A core must satisfy the lawful safety standard for a power supply circuit issued in each country. The safety standard requests for instance the minimum duration between pins, the minimum duration between a core and a pin, et al.

(e) A core must be small in size, and light in weight. And the output power of a transformer for each unit weight (gr) is as large as possible.

(f) Preferably, the external shape of a core is rectangular for saving the mounting area of the transformer on a printed circuit board, and the shape of the central core is circular for the sake of the winding.

(g) The manufacturing process of a core is simple, and a core is mechanically strong. If a core has a sharp or edged portion, that portion will be broken easily.

The most popular conventional ferrite core is E-shaped with an identical cross section, or alternatively, a combination of the E-shaped core and the I-shaped core being utilized. However, that core has the disadvantages that the size is large, the shield effect is poor, and further since a bobbin must be rectangular, windings are folded and thus, the insulation is not sufficient and the winding automatically is difficult.

Another conventional ferrite core is a so-called pot core which has a closed outer wall and a center boss mounted at the center of the base plate. Although a pot core is excellent for the use in a high frequency because of the excellent shield effect, that pot core has the disadvantage in using for a power supply transformer that it is difficult to extend lead wires of windings outside, since a slit for accepting lead wires is too small in that pot core.

Another prior ferrite core is shown in UK Pat. No. 1306597 which has a pair of thick diametrically opposed outer legs. That core is proposed for the use in a high frequency filter, but is not suitable for a power supply transformer, since the shield effect is poor, the size of the transformer is large, and a lead wire crosses with another lead wire.

Another prior ferrite core is shown in UK Pat. No. 1169742 which has four legs and the center boss at the center of those legs. Although that core is advantageous to extend lead wires to an external circuit through the wide window between legs, that core has the disadvantage that the core is apt to saturate at the leg portions, since those legs are rather thin. Therefore, that core is advantageous for the use of the high output voltage application, but is not suitable for a power supply transformer with much current.

Another prior ferrite core is the modification of a so-called pot core, and a pot core is separated into two substantially U-shaped portions. This shape is preferable to improve the shield effect, but has the disadvantage that it is difficult to connect lead wires to an external circuit.

Still another prior ferrite core has the wide disk between the center core and the outer walls. However, in this core, the structure of a bobbin is rather complicated, and the core is apt to saturate, thus, that core is not suitable for the use of a high power transformer.

Therefore, the present applicant proposed the improved structure of a ferrite core which is suitable for a power transformer as shown in FIG. 1 (U.S. Pat. No. 4,352,080).

That ferrite core in FIG. 1 has a center boss 1, a pair of outer walls 2 and 3, and a pair of sector shaped base plates 4 and 5 which couple said center boss 1 with said outer walls 2 and 3. The width B of the outer walls 2 and 3, and the diameter of the circle (*2a, 3a*) of the outer walls are larger than the diameter $d_1$ of the center boss 1 so that the outer walls 2 and 3 enclose substantially the center boss 1 and the coil wound on the boss 1, therefore, that core has the excellent magnetic shield effect, and a thick lead wire can go out through the opening between the base plates. However, the core of FIG. 1 has the disadvantage that the width B of the core is rather large, and that width B determines substantially the height of the transformer when the transformer using that core is mounted on a printed circuit board. Therefore, when that core is used, the height of the transformer is rather high, and the mounting arrangement of components on a printed circuit board is considerably restricted by the presence of the transformer.

SUMMARY OF THE INVENTION

It is an object, therefore, of the present invention to overcome the disadvantages and limitations of a prior ferrite core by providing a new and improved ferrite core.

It is also an object of the present invention to provide a ferrite core for the use of a power supply circuit with low height when it is mounted on a printed circuit board.

It is also an object of the present invention to provide a ferrite core for the use of a power supply circuit with no magnetic saturation, small size, and the excellent shield effect.

The present ferrite core is assembled by a pair of identical core halves, and each of the core halves is comprised of (a) a circular center boss (6), (b) a pair of outer walls (7, 8) positioned at both the sides of said boss for mounting a coil, (c) a pair of base plates (9, 10) coupling a portion of said boss with said outer walls, said base plates extending from the periphery of said boss to the side surface of said walls wherein said boss, walls and base plates form an E-shaped structure and wherein the end portion of said boss, end portions of said walls and said base plates are all aligned in a single plane, (d) each of the outer walls being substantially rectangular with an external linear wall and an inner curved wall which is substantially coaxial with said circular boss and the width of said external linear wall being larger than the diameter ($2a_1$) of the circular boss, (e) each of said base plates being substantially in an arc shape, and the portions of said boss which are coupled to said base plates being less than the whole of the periphery of said boss such that a space is formed between said base plates along the periphery of said boss, (f) the area ($S_6$, $S_7$) coupling said base plates with said outer walls being equal to or larger than the half of the cross-sectional area ($S_1=\pi a_1^2$) of said boss, (g) the area ($S_2$, $S_3$) coupling said boss with the base plates being substantially the same as half of the cross-sectional area ($S_1=\pi a_1^2$) of said boss, (h) the area ($S_4$, $S_5$) of the cross-section of each of said outer walls being equal to or larger than the half of the cross-sectional area ($\pi a_1^2$) of said boss, (i) the core half being symmetrical with regard to the first plane including a center axis of said boss and being parallel with the external linear walls of said outer walls, (j) a concaved opening (R) being provided between said base plates in first side of the core half with regard to the reference plane which includes a center axis of said boss and is perpendicular to said first plane, and said opening (R) extending to the surface of the boss, (k) the length ($B_1$) between said reference plane to the end of the first side of the core half in the first side which includes said concaved opening being longer than the length ($B_2$) between said reference plane to the end of the second side which does not have said opening (R), and (1) said length ($B_2$) being the same as the radius $a_1$ of the center boss.

BRIEF DESCRIPTION OF THE DRAWINGS

The foregoing and other objects, features, and attendant advantages of the present invention will be appreciated as the same become better understood by means of the following description and accompanying drawings.

DESCRIPTION OF THE PREFERRED EMBODIMENTS

The transformer utilizing the present ferrite core utilizes two substantially identical core halves of magnetic material butting together, and a core half is shown in the FIGS. 2 through 8. The core half is formed integrally with a circular boss 6, a pair of outer walls 7 and 8, and a pair of base plates 9 and 10 coupling said boss 6 with said outer walls 7 and 8. The inner faces 7*b* and 8*b* of the two outer walls 7 and 8 are inwardly curved so that when a core half is formed by assembling two core halves with their outer portions and boss butting together a cylindrical space is left around the boss and between the outer walls for accommodating a bobbin and one or more coils wound on the bobbin.

The boss 6 is in the shape of a circular post as shown in each of the drawings. Each of the outer walls 7 and 8 are a substantially rectangular plate but the inner surface of the same is curved. The height (H) of the outer walls is the same as the height of the boss 6. The extreme end 6*a* of the center boss 6, the extreme ends of the outer walls 7 and 8 are positioned on a single plane which is parallel to the base plates. At the end of boss 6 and the outer walls 7 and 8, a pair of arc shaped base plates 9 and 10 are provided, and as apparent from each of the drawings, the inner surface of those base plates coincides with the outer surface of the boss 6, and the outer surface of those base plates coincides with the inner curved surface of the outer walls 7 and 8. It should be appreciated that each of outer walls 7 and 8 are positioned so that they are symmetrical with regard to the first plane which includes the center axis of the center boss 6 and is parallel to the external linear walls of the outer walls 7 and 8.

Figure 1:
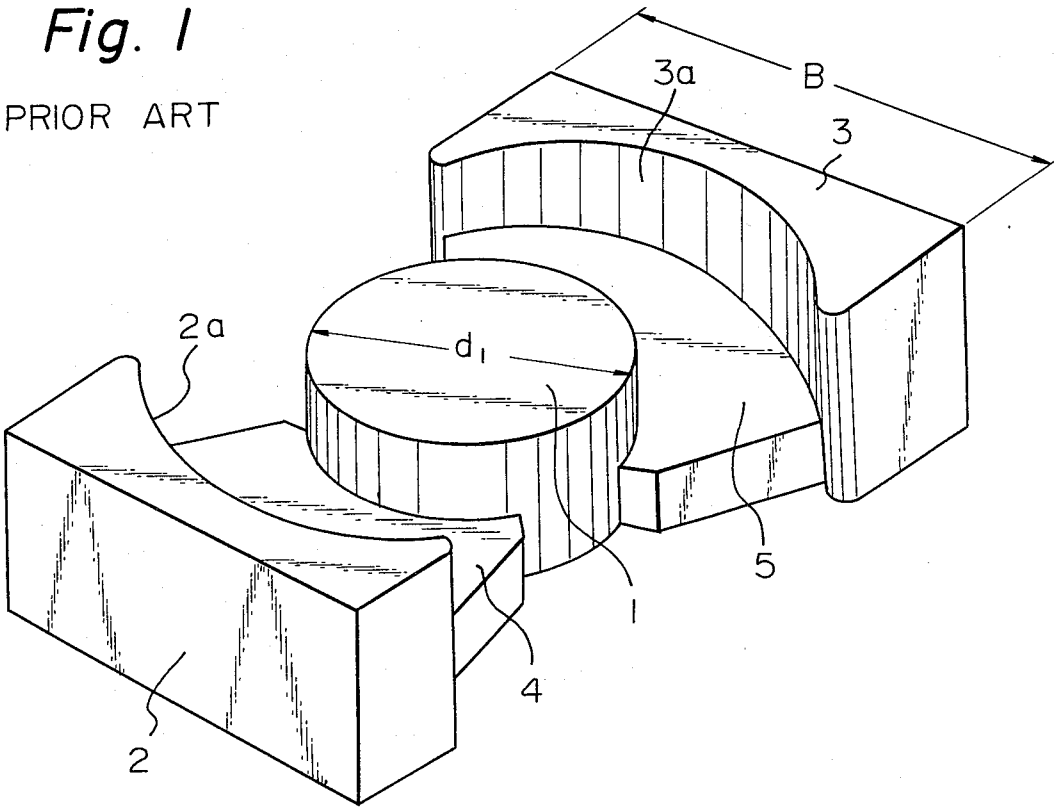
Fig. 1 PRIOR ART
FIG. 1 is the perspective view of the prior core half.
Figure 2:
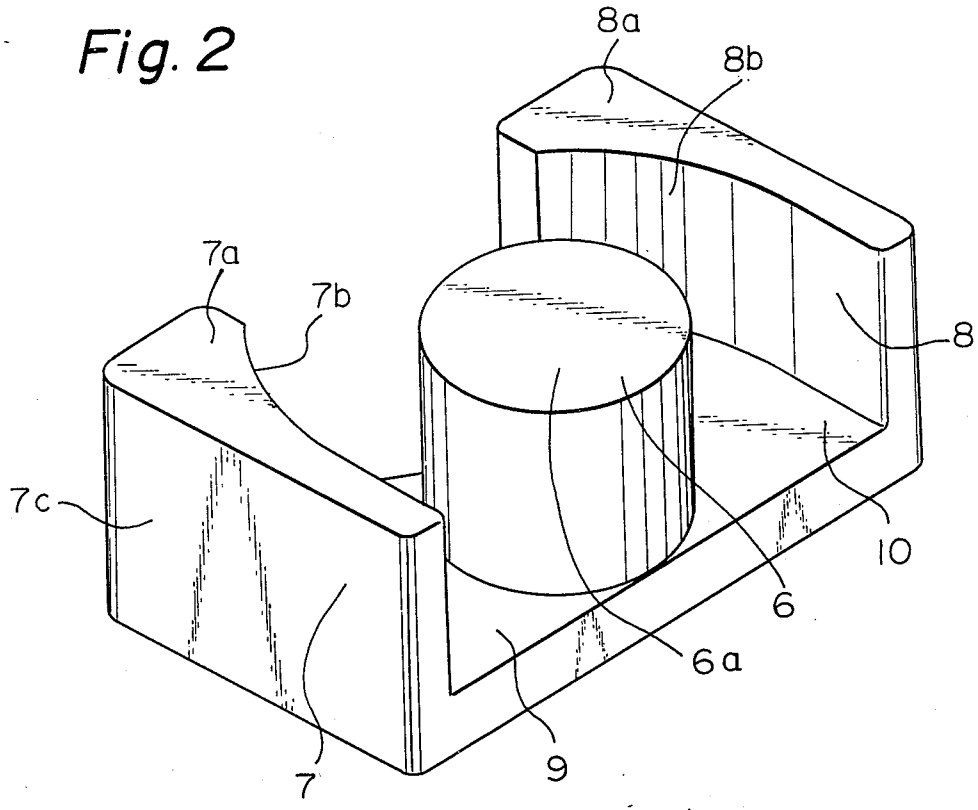
FIG. 2 is the perspective view of the core half according to the present invention.
Figure 3:
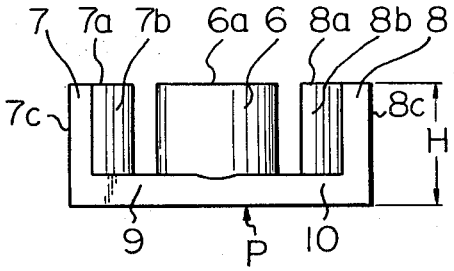
FIG. 3(A) is the front view of the core half of FIG. 2.
FIG. 3(B) is the modification of FIG. 3(A)
Figure 3:
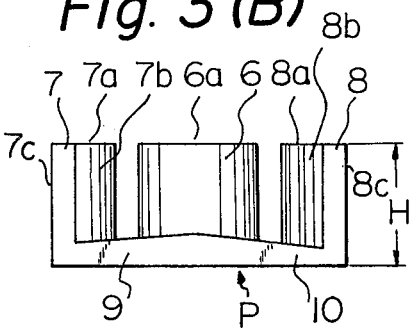
Figure 4:
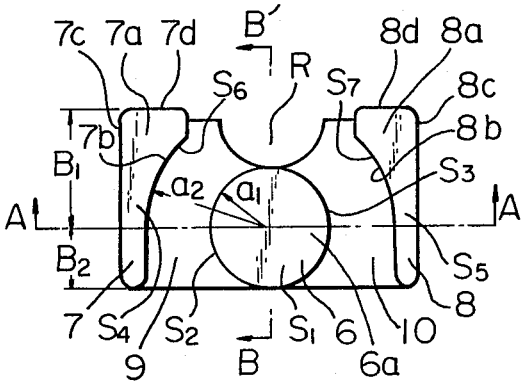
FIG. 4 is the plane view of the core half of FIG. 2.
Figure 6:
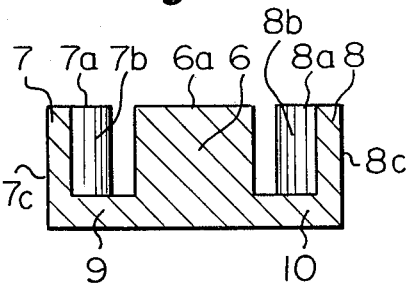
FIG. 6 is the cross sectional view at the line A—A of FIG. 4.
Figure 5:
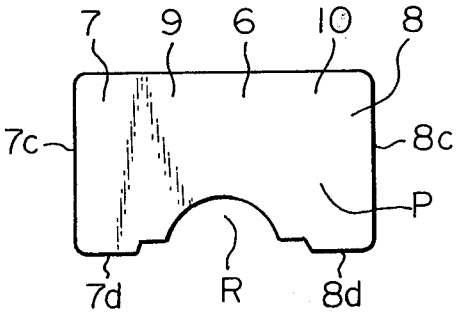
FIG. 5 is the bottom view of the core half of FIG. 2.
Figure 7:
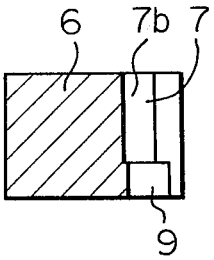
FIG. 7 is the cross sectional view at the line B—B of FIG. 4.

The reference plane is defined so that said reference plane is perpendicular to said first plane, and the reference plane includes the center axis of the boss 6 and the line A—A of FIG. 4. It should be noted in FIG. 4 that a core half is asymmetrical with regard to the reference plane, but the length $B_1$ in the first side is longer than the length $B_2$ in the second side. The curved inner surfaces of those outer walls 7 and 8 are coaxial with the center boss 6. The external wall of the first outer wall 7 is parallel to that of the second outer wall 8, so that the external appearance of the present core half is almost rectangular.

The core half is produced by for instance Mn-Zn ferrite through molding process, sintering process and finish process.

In the first side of the reference plane, the width $B_1$ which is the length between the end of the outer walls 7 and 8, and the reference plane, is longer than the length $a_1$ which is the radius of the center boss 6. In said first side, the radius $a_2$ of the inner surface of the walls 7 and 8 is longer than the radius $a_1$ of the boss, and preferably, $a_1$ is in the range between 15% and 70% of $a_2$, and still preferably, $a_1$ is 50% of $a_2$. With the above dimension, the outer walls 7 and 8 may substantially enclose the center boss 6 and windings around the boss 6, and then, the excellent magnetic shield effect is obtained. The first side has a concaved opening R at the center of the two outer walls. That concaved opening R reaches the surface of the center boss 6, and lead wires of the coils may pass through that concaved opening R.

In the second side which is the opposite side in view of said reference plane, the width $B_2$ which is the length between the reference plane and the end of the outer walls 7 and 8, is the same as the radium $a_2$, and of course, that width $B_2$ is shorter than the width $B_1$ of the first side. Preferably, the length $B_2$ is shorter than half of $B_1$. The inner surface of the outer walls in the second side may be either flat as shown in FIG. 4, or circular with the radius $a_2$. Due to the short length $B_2$, the height of the transformer is low when the transformer is mounted on a printed circuit board, and then, an electronic component with small size is obtained.

When a pair of said core halves compose a transformer, the end 6*a* of the boss 6, and the ends 7*a* and 8*a* of the outer walls 7 and 8 of the first core half abut with the corrensponding ends of the second core half through a bobbin. Thus, a magnetic circuit from the boss of the first core half through the base plates and the outer walls of the first core half, the outer walls and the base plates of the second core half, to the center boss to the second core half is provided.

In order to assure the reasonable distribution of the magnetic flux in the cores, and prevent the partial saturation of the magnetic flux in the cores, the size of the core is selected as follows.

Assuming that the cross sectional area of the center boss 6 is $S_1$ ($=\pi a_1^2$), the area for coupling said center boss 6 with the base plates 9 and 10 is $S_2$ ($=S_3$), the area for coupling said base plates with the outer walls 7 and 8 is $S_6$ ($=S_7$), and the cross sectional area of the outer walls 7 and 8 is $S_4$ ($=S_5$), then, the following relationship is satisfied:

$$S_1=S_2+S_3=S_4+S_5 \quad (1)$$

With the above relationship, each portion of the cores does not partially saturate magnetically, and therefore, a core may be relatively small in size and light in weight, and thus, the capacity of the transformer for each weight of the transformer becomes large.

Further, when the width of the base plates 9 and 10 is not uniform, but said width is thick at the coupling portion with the center boss, and is thin at the coupling portion with the outer walls, it is possible to satisfy the following equation:

$$S_1=S_2+S_3=S_4+S_5=S_6+S_7 \quad (2)$$

In that case, the thickness of the base plates reduces linearly from the center boss to the outer walls (see FIG. 3(B)). When the equation (2) is satisfied, the capacity for each weight of the transformer is further improved.

When the base plates are the same as each other, and the outer walls are the same as each other, the relations $S_2=S_3$, $S_4=S_5$, and $S_6=S_7$ are satisfied, and said equations (1) and (2) are expressed as follows.

$$S_1=2S_2=2S_4,$$

and $$S_1=2S_2=2S_4=2S_6$$

It should be noted that as far as said equation (1) or (2) is satisfied, a partial saturation of flux is prevented even when base plates and/or outer walls are not symmetrical with each other.

Preferably, each corner or the end portions of the base plates and the outer walls are curved but are not sharp so that those end portions do not injure a lead wire of a transformer, and a core itself is not broken.

It should be appreciated that the present core half has a large opening R, which facilitates the passing of a lead wire for coupling a coil with an external circuit. That opening can pass a thick lead wire of even 1.5 mm of diameter, which is used in a large current transformer.

Further, it should be appreciated in each of the drawings that the shape of each portion of a core half is designed to be pleasing to the eye.

Further, it should be appreciated that the present core half has three openings around the center boss 6, and those openings facilitate the ventilation, for cooling the transformer.

Figure 8:
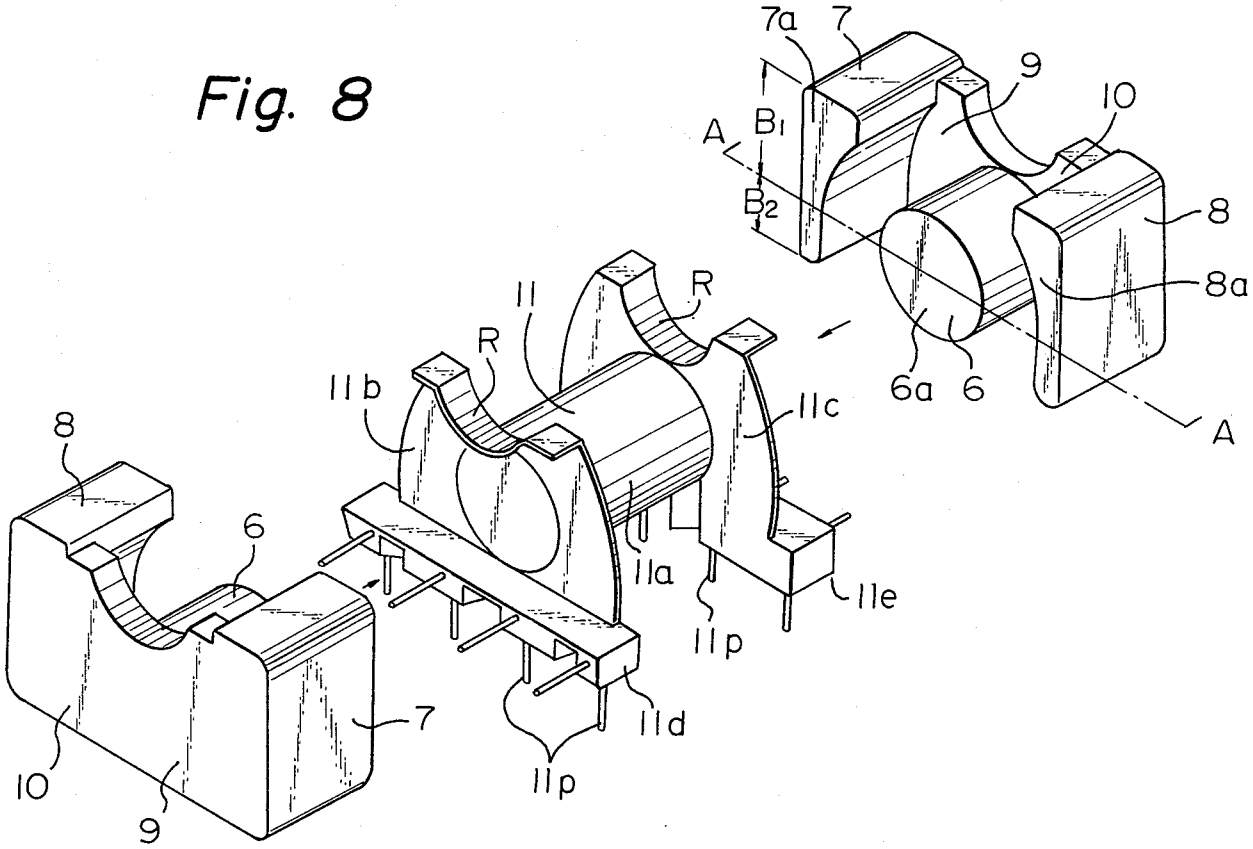
FIG. 8 is the disassembled perspective view of a transformer which uses a pair of core halves of FIG. 2.
Figure 9A:
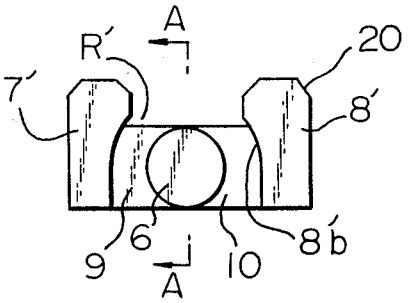
FIG. 9(A) is the plane view of another core half according to the present invention.
Figure 9B:
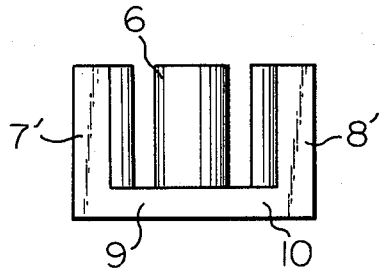
FIG. 9(B) is the front view of the core half of FIG. 9(A)
Figure 9C:
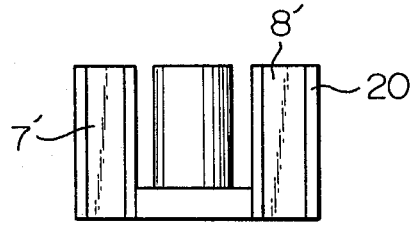
FIG. 9(C) is the back view of the core half of FIG. 9(A)
Figure 9D:
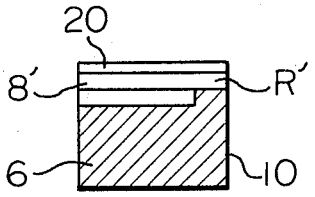
FIG. 9(D) is the cross section at the line A—A of FIG. 9(A).

FIG. 8 shows a disassembled view of a transformer which uses the present cores.

In FIG. 8, a bobbin 11 has a cylindrical hollow portion 11*a*, a pair of flanges 11*b* and 11*c* at both the ends of the cylindrical portion 11*a*, and a pair of terminals 11*d* and 11*e* coupled with said flanges. The terminals 11*d* and 11*e* have a plurality of conductive pins 11*p*, which facilitate to couple the transformer with an external circuit on a printed circuit board. The flanges 11*b* and 11*c* are almost circular, and have a concaved recess R relating to the concaved opening of the core halves as shown in FIG. 8. After a coil (not shown) is wound on the bobbin, a pair of core halves are mounted on the bobbin so that the end 6*a* of the boss 6 of the first core half abuts to the corresponding portion of the second core half, and the first sides are positioned upside and the second sides are positioned lowerside as shown in the figure. The assembled bobbin together with a coil, and the core halves are mounted on a printed circuit board by using the pins 11*p*. It should be noted, therefore, that the height of the present transformer on a printed circuit board is low as compared with a prior transformer since the width $B_2$ of the second side of the core half is shorter than the width $B_1$ of the first side.

In one embodiment, the transformer with the longest side 19 mm with the structure of the present invention can provide the output power 100 watts when the frequency is 100 kHz, and that transformer is used, for instance, in a power supply circuit in a portable battery operated video tape recorder.

FIGS. 9(A) through 9(D) show the modification of the present core half, in which the reference numeral 6 is the center boss, 7' and 8' are outer walls, 9 and 10 are base plates, R' is the recess corresponding to the concaved opening R. The features of the embodiment of FIGS. 9(A) through 9(D) are that the recess R' extends up to the outer walls 7' and 8', said recess R' touches directly with the center boss 6, and the corner 20 of the outer walls 7' and 8' is not curved, but that corner 20 is flat with the angle of approximately 45° with the adjacent planes.

From the foregoing, it will now be apparent that a new and improved ferrite core has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A ferrite core half for use in a power supply circuit comprising:

(a) a circular center boss (6), (b) a pair of outer walls (7, 8) positioned at both the sides of said boss for mounting a coil, (c) a pair of base plates (9, 10) coupling a portion of said boss with said outer walls, said base plates extending from the periphery of said boss to the side surface of said walls wherein said boss, walls and base plates form an E-shaped structure and wherein the end portion of said boss, end portions of said walls and said base plates are all aligned in a single plane, (d) each of the outer walls is substantially rectangular with an external linear wall and an inner curved wall which is substantially coaxial with said circular boss and the width of said external linear wall is larger than the diameter ($2a_1$) of the circular boss, (e) each of said base plates being substantially in an arc shape, and the portions of said boss which are coupled to said base plates being less than the whole of the periphery of said boss such that a space is formed between said base plates along the periphery of said boss, (f) the area ($S_6$, $S_7$) coupling said base plates with said outer walls being equal to or larger than the half of the cross-sectional area ($S_1=\pi a_1^2$) of said boss, (g) the area ($S_2$, $S_3$) coupling said boss with the base plates being substantially the same as half of the cross-sectional area ($S_1=\pi a_1^2$) of said boss, (h) the area ($S_4$, $S_5$) of the cross-section of each of said outer walls being equal to or larger than the half of the cross-sectional area ($\pi a_1^2$) of said boss, (i) the core half being symmetrical with regard to a first plane including a center axis of said boss and being parallel with the external linear walls of said outer walls, (j) a concaved opening (R) being provided between said base plates in a first side of the core half with regard to a reference plane which includes a center axis of said boss and is perpendicular to said first plane, and said opening (R) extending to the surface of the center boss, (k) the length ($B_1$) between said reference plane to the end of the first side of the core half in the first side which includes said concaved opening being longer than the length ($B_2$) between said reference plane to the end of a second side of the core half, and (l) said length ($B_2$) being the same as the radius $a_1$ of the center boss.

2. A ferrite core half according to claim 1, wherein the cross section of each of said base plate is tapered so that the coupling portion with the center boss is thick and the coupling portion with the outer walls is thin, and the area ($S_6$, $S_7$) coupling the base plates with the outer walls is equal to the half of the cross-sectional area ($S_1=\pi a_1^2$) of the boss.

3. A ferrite core half according to claim 1, wherein the radius $a_1$ of the center boss is in the range between 15% and 70% of the radius $a_2$ of the inner surface of the outer walls (7, 8).

4. A ferrite core half according to claim 1, wherein said concaved opening (R) is in a half circular shape contacting with the center boss.

5. A ferrite core half according to claim 1, wherein said concaved opening (R) is in a rectangular shape extending between a pair of outer walls (7, 8), and contacting with the center boss.

6. A ferrite core half according to claim 1, wherein corners of the outer walls (7, 8) are curved.

7. A ferrite core half according to claim 5, wherein the corners of the outer walls (7, 8) in the first side have a plane which crosses with adjacent planes at 45°.

* * * * *